US009022626B2

(12) United States Patent
Kumar et al.

(10) Patent No.: US 9,022,626 B2
(45) Date of Patent: May 5, 2015

(54) SIGNAL ASSEMBLIES PROVIDING UNIFORM ILLUMINATION THROUGH LIGHT SOURCE LOCATION AND SPACING CONTROL

(71) Applicant: Ford Global Technologies, LLC, Dearborn, MI (US)

(72) Inventors: Arun Kumar, Farmington Hills, MI (US); Mahendra Somasara Dassanayake, Bloomfield Hills, MI (US); Martin David Witte, Warren, MI (US); Richard Joseph Michaels, III, Kailua, HI (US)

(73) Assignee: Ford Global Technologies, LLC, Dearborn, MI (US)

( * ) Notice: Subject to any disclaimer, the term of this patent is extended or adjusted under 35 U.S.C. 154(b) by 155 days.

(21) Appl. No.: 13/797,120

(22) Filed: Mar. 12, 2013

(65) Prior Publication Data

US 2014/0268853 A1 Sep. 18, 2014

(51) Int. Cl.

| | |
|---|---|
| ***F21V 21/00*** | (2006.01) |
| ***F21V 13/02*** | (2006.01) |
| ***F21S 8/10*** | (2006.01) |

(52) U.S. Cl.

CPC ..... *F21V 13/02* (2013.01); *F21S 48/22* (2013.01); *F21S 48/211* (2013.01); *F21S 48/215* (2013.01); *F21S 48/238* (2013.01); *F21S 48/234* (2013.01)

(58) Field of Classification Search

CPC ..... F21V 13/02; F21S 48/22
USPC ..... 362/545, 235, 520, 249.02
See application file for complete search history.

(56) References Cited

U.S. PATENT DOCUMENTS

| | | | |
|---|---|---|---|
| 6,280,044 | B1 | 8/2001 | Kusakabe |
| 2011/0179683 | A1 | 7/2011 | Khan |

*Primary Examiner* — Vip Patel
(74) *Attorney, Agent, or Firm* — Raymond Coppiellie; Price Heneveld LLP

(57) ABSTRACT

A signal assembly is provided that includes a chamber defined by isotropically luminant back and side surfaces, and a front surface having a lens and a diffuser. The signal assembly also includes LED light sources having a beam angle ≥70° coupled to the back surface. The back and front surfaces are separated by a depth, and each source is located at a spacing from the other sources ≤the depth divided by a predetermined factor. The predetermined factor may be set to approximately 2.5 or 2.0 when the divergence angle of the diffuser is ≥20° or ≥30°, respectively. The signal assembly and its components can be configured to operate as a vehicular signal lamp.

20 Claims, 3 Drawing Sheets

SIGNAL ASSEMBLIES PROVIDING UNIFORM ILLUMINATION THROUGH LIGHT SOURCE LOCATION AND SPACING CONTROL

FIELD OF THE INVENTION

The present invention generally relates to signal assemblies that provide uniform illumination through light source location and spacing control, and more particularly to vehicular signal lamps with LED light sources located and spaced to provide uniform illumination.

BACKGROUND OF THE INVENTION

Various LED signal assemblies are employed today with great practical effect. In the automotive industry, many vehicles utilize LED-based lighting assemblies, taking advantage of their much lower energy usage as compared to other light sources, including halogen- and incandescent-based systems. One problem associated with LEDs is that they tend to produce highly directional light. The light emanating from conventional LED-based vehicular lighting assemblies often has low uniformity and hot spots. Consequently, conventional LED-based lighting assemblies have a significant drawback when used in vehicle applications requiring high uniformity—i.e., signal lamps.

Accordingly, there is a need for signal assemblies, and LED-based vehicular signal assemblies, that exhibit a high degree of light uniformity while operating at high efficiencies.

SUMMARY OF THE INVENTION

One aspect of the present invention is to provide a signal assembly that includes a chamber defined by isotropically luminant back and side surfaces, and a front surface having a lens and a diffuser. The signal assembly also includes LED light sources having a beam angle ≥70° coupled to the back surface. The back and front surfaces are separated by a depth, and each source is located at a spacing from the other sources ≤the depth divided by a predetermined factor.

Another aspect of the present invention is to provide a signal assembly that includes a chamber defined by isotropically luminant back and side surfaces, and a front surface having a lens and a diffuser. The signal assembly also includes LED light sources having a beam angle ≥100° coupled to the back surface. The back and front surfaces are separated by a depth, and each source is located at a spacing from the other sources ≤the depth divided by a predetermined factor.

A further aspect of the present invention is to provide a signal assembly that includes a chamber defined by isotropically luminant top, bottom, and back surfaces, a depth, a front surface having a lens aperture and a diffuser. The signal assembly further includes bi-directional LED light sources coupled to the back surface, each having beam angles ≥light exit angles defined by the sources and the aperture. Each source is located at a spacing from the other sources ≤the depth divided by a predetermined factor.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1A:
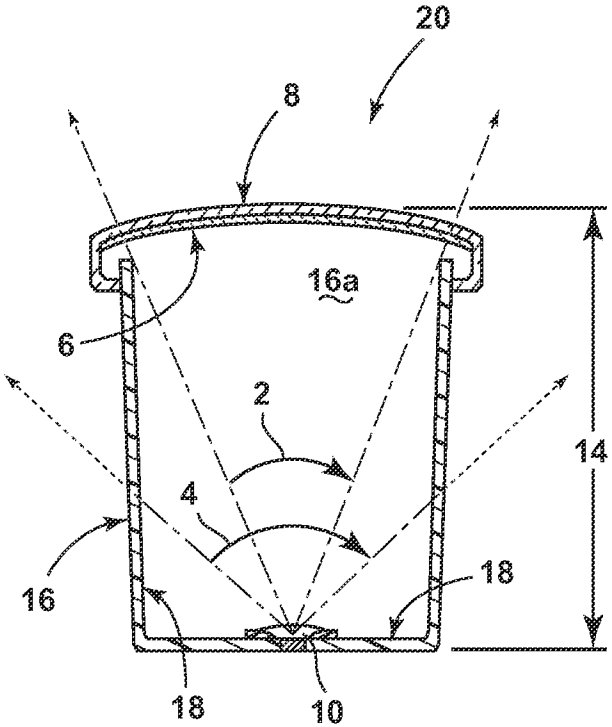
FIG. 1A is a cross-sectional view of the signal assembly depicted in FIG. 1.
Figure 1:
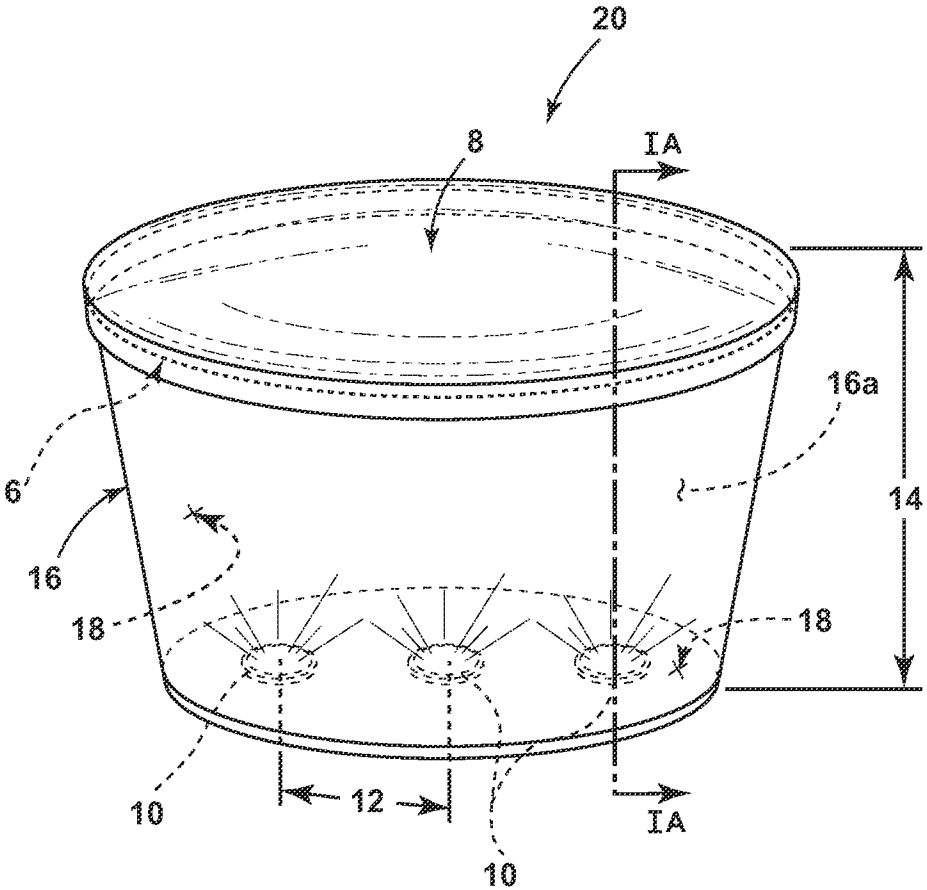
FIG. 1 is a cut-away perspective view of a signal assembly with a spherical lens aperture according to one embodiment.

For purposes of description herein, the terms "upper," "lower," "right," "left," "rear," "front," "vertical," "horizontal," and derivatives thereof shall relate to the invention as oriented in FIGS. 1 and 1A. However, the invention may assume various alternative orientations, except where expressly specified to the contrary. Also, the specific devices illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

LED signal assemblies are employed today with great practical effect. In the automotive industry, many vehicles now utilize LED-based lighting assemblies. Much of the engineering work in connection with these vehicle lighting assemblies emphasizes a reduction in their overall dimensions, particularly depth, for space saving and fuel efficiency benefits (i.e., "low-profile" lighting assemblies). Further, these LED-based vehicular assemblies rely on multiple LED light sources, each inherently producing high light intensity with small beam angles. Accordingly, many LED-based lighting assemblies, including "low-profile" assemblies, produce "hot spots" of discrete light associated with each LED light source.

What has not been previously understood is how to configure and design such LED-based lighting assemblies to produce highly uniform light for vehicular signal applications, including applications requiring "low profile" assemblies. Highly uniform light is particularly beneficial for vehicular signal applications (e.g., brake lights, taillights, daytime running lights (DRLs), turn signals, reverse lamps, etc.). Further, vehicular lighting assemblies that produce highly uniform light are desirable for many vehicle owners for aesthetic reasons. Referring to FIGS. 1 and 1A, a signal assembly 20 with a spherically-shaped lens aperture 8 is depicted according to one embodiment. Signal assembly 20 produces highly uniform light emanating from LED sources 10 for use in vehicular signal applications, among other lighting fields.

Signal assembly 20 includes a chamber 16 defined by isotropically luminant back and side surfaces 18, and a front surface having a lens aperture 8 and a diffuser 6. As depicted in exemplary fashion in FIGS. 1 and 1A, chamber 16 is arranged in a substantially cylindrical shape with interior isotropically luminant back and side surfaces 18 (e.g., Makrofol® films provided by Bayer MaterialsScience LLC, White97™ films provided by WhiteOptics™, LLC, etc.). Further, signal assembly 20 also includes LED light sources 10.

As shown, each of the LED light sources 10 is coupled to the back surface of the chamber 16, within cavity 16*a*, and produces light rays with a beam angle 4 (see FIG. 1A). LED light sources 10 used in signal assembly 20 may produce light with a beam angle 4≥70°, and more preferably, beam angle 4≥100°. Further, the cavity 16*a*, each source 10, and the lens aperture 8 define a lens exit angle 2 (see FIG. 1A). Accordingly, the light that emanates from light sources 10 is directed toward the diffuser 6 and lens aperture 8 at a beam angle 4, but further confined by lens exit angle 2. As such, some light emanating from sources 10 impinges on the isotropically luminant surfaces 18 rather than directly exiting through diffuser 6 and aperture 8. These light rays, by virtue of striking isotropically luminant surfaces 18, are reflected and spread within cavity 16*a*. Eventually, these reflected light rays also exit cavity 16*a* through diffuser 6 and lens aperture 8.

Light rays within cavity 16*a* that have emanated directly from sources 10, and those that have been reflected off of isotropically luminant surfaces 18, pass through diffuser 6. Diffuser 6 then causes the light rays originating from sources 10, typically LED-based sources, to further scatter and spread. This has the effect of improving the uniformity of the light rays exiting diffuser 6 and, ultimately, aperture 8. Diffuser 6 may be fabricated from known diffuser technologies (e.g., Light Shaping Diffuser® films provided by Luminit, LLC). Diffuser 6 can possess a divergence angle ≥15°, ≥20°, or even ≥30°.

The back and front surfaces of chamber 16 are separated by a depth 14, as further depicted in FIGS. 1 and 1A. Each light source 10 is located at a spacing 12, apart from immediately adjacent sources 10. The relationship between the spacing 12 and depth 14 is an aspect of signal assembly 20 that allows it to produce highly uniform light emanating from aperture 8. In particular, the spacing 12 (d) of the sources 10 is set≤the depth 14 (D) of the assembly 20 divided by a predetermined factor, A. As such, the relationship of spacing 12, depth 14 and the predetermined factor A for signal assembly 20 can be expressed as: D/d≥A. For a diffuser 6 with a divergence angle ≥20° and source 10 with a beam angle 4≥70°, the predetermined factor A can be set to approximately 2.5. When a diffuser 6 is employed with a divergence angle ≥30°, the predetermined factor A can be set at approximately 2.0. If the beam angle 4 is changed to ≥100° and the divergence angle of diffuser 6 is ≥15°, the predetermined factor A can be set to approximately 2.5.

Signal assembly 20 is particularly effective at producing highly uniform light that emanates from lens aperture 8 through the control of depth 14 relative to spacing 12. In essence, signal assembly 20 allows light emanating from each of multiple LED sources 10 to blend before exiting the cavity 16*a* via diffuser 6 and aperture 8. By increasing the depth 14 of the chamber 16 relative to the spacing 12, the relationship D/d≥A is satisfied. As the light sources 10 are situated further back within cavity 16*a*, a greater percentage of the incident light from these sources 10 can blend before exiting the cavity 16*a* and chamber 16. Referring to FIG. 1A, the movement of sources 10 back further in the chamber 16 increases the depth 14, thereby allowing more incident light from each source 10 to impinge on isotropically luminant surfaces 18 and blend with incident light from adjacent light sources 10. The net result is increased uniformity of light that exits aperture 8. For example, signal assembly 20 can produce highly uniform light that exits aperture 8 with efficiencies that approach 20% by utilizing the foregoing D/d≥A relationship.

Figure 2:
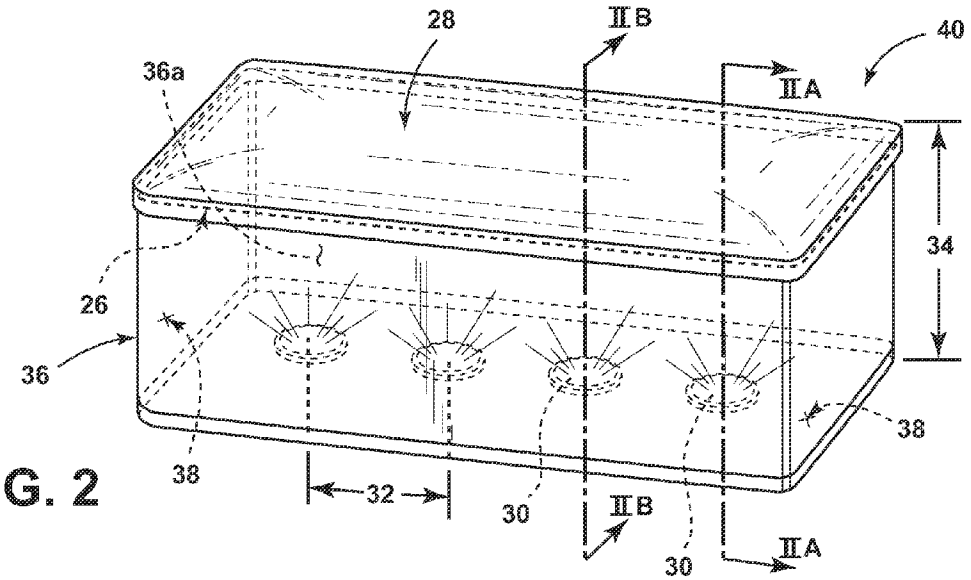
FIG. 2 is a cut-away perspective view of a signal assembly with a rectangular lens aperture according to another embodiment.
Figure 2B:
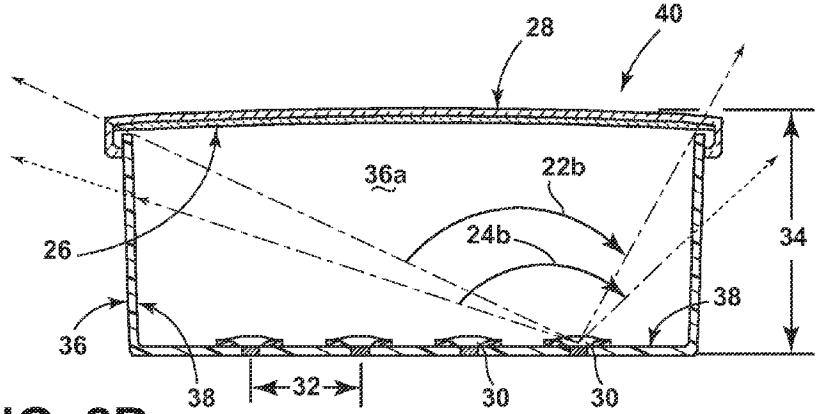
FIG. 2B is a cross-sectional view through another side of the signal assembly depicted in FIG. 2.
Figure 2A:
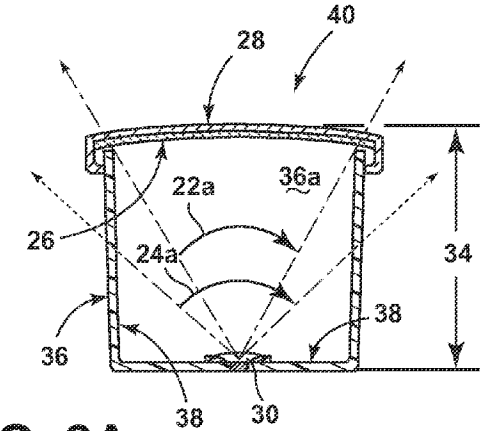
FIG. 2A is a cross-sectional view through one side of the signal assembly depicted in FIG. 2.

Referring to FIGS. 2, 2A and 2B, a signal assembly 40 with a rectangular-shaped lens aperture 28 is depicted according to another embodiment. Signal assembly 40 also produces highly uniform light emanating from LED sources for use in vehicular signal applications, among other lighting fields. In general, signal assembly 40 is arranged, and performs comparably to, signal assembly 20 (see FIGS. 1, 1A). As shown, signal assembly 40 includes a chamber 36 defined by isotropically luminant back and side surfaces 38, and a front surface having a lens aperture 28 and a diffuser 26. Chamber 36 is further arranged in a substantially rectangular cuboid shape containing a cavity 36*a* defined by interior isotropically luminant back and side surfaces 38. Further, signal assembly 40 includes LED light sources 30.

Each of the LED light sources 30 is coupled to the back surface of the chamber 36, within cavity 36*a*, and produces light rays with a beam angle 24*a* and 24*b* (see FIGS. 2A and 2B, respectively). As such, the LED light sources 30 used in signal assembly 40 can be bi-directional in the sense that they possess beam angles that vary from one another in at least two directions, creating a non-circular emanation pattern. In particular, the sources 30 may produce an elliptical cone of light with beam angles 24*a*, 24*b*≥70°, and more preferably, beam angles 24*a*, 24*b*≥100°. Further, the cavity 36*a*, each source 30, and the lens aperture 28 define lens exit angles 22*a* and 22*b* (see FIGS. 2A and 2B, respectively). Accordingly, the light that emanates from light sources 30 is directed toward the diffuser 26 and lens aperture 28 at beam angles 24*a* and 24*b*, but further confined by lens exit angles 22*a* and 22*b*, respectively. As such, some light emanating from sources 30 impinges on the isotropically luminant surfaces 38 rather than directly exiting through diffuser 26 and aperture 28. These light rays, by virtue of striking isotropically luminant surfaces 38, are reflected and spread within cavity 36*a*. Eventually, these reflected light rays also exit cavity 36*a* through diffuser 26 and lens aperture 28.

Light rays within cavity 36*a* that have emanated directly from sources 30, and those that have been reflected off of isotropically luminant surfaces 38, pass through diffuser 26. Diffuser 26 then causes the light rays originating from sources 30, typically LED-based sources, to further scatter and spread. This improves the uniformity of the light rays exiting diffuser 26 and, ultimately, aperture 28. Diffuser 26 may also be fabricated from known diffuser technologies (e.g., Light Shaping Diffuser® films provided by Luminit, LLC), and can possess a divergence angle ≥15°, ≥20°, or even ≥30°.

As shown in FIGS. 2, 2A and 2B, the back and front surfaces of chamber 36 are separated by a depth 34. Each light source 30 is located at a spacing 32, apart from immediately adjacent sources 30. The relationship between the spacing 32 and depth 34 is an aspect of signal assembly 40 that allows it to produce highly uniform light emanating from aperture 28. In particular, the spacing 32 (*d*) of the sources 30 is set ≤the depth 34 (D) of the assembly 40 divided by a predetermined factor, A. As such, the relationship of spacing 32, depth 34 and a predetermined factor A for signal assembly 40 can be expressed as: D/d≥A. The foregoing relationship for signal assembly 40 is similar to that highlighted earlier with respect to signal assembly 20. When diffuser 26 is employed with a divergence angle ≥20° in signal assembly 40, and the beam angles 24*a* and 24*b* are greater than the lens exit angles 22*a* and 24*b*, respectively, the predetermined factor A can be set to approximately 1.0. However, the predetermined factor A may need to be increased (e.g., to achieve superior uniformity levels) when the beam angles 24*a* and 24*b* are relatively narrow (e.g., ≥70°), despite being larger than the lens exit angles 22*a* and 24*b*.

Signal assembly 40 is particularly effective at producing highly uniform light that emanates from a relatively narrow lens aperture 28 through the control of depth 34 relative to spacing 32. In essence, signal assembly 40 allows light emanating from each of multiple LED sources 30 to blend before exiting the cavity 36*a* via diffuser 26 and aperture 28. By increasing the depth 34 of the chamber 36 relative to the spacing 32, the relationship D/d≥A is satisfied. As the light sources 30 are situated further back within cavity 36*a*, a greater percentage of the incident light from these sources 30 can blend before exiting the cavity 36*a* and chamber 36. Referring to FIGS. 2A and 2B, the movement of sources 30 back further in the chamber 36 increases the depth 34, thereby allowing more incident light from each source 30 to impinge on isotropically luminant surfaces 38 and blend with incident light from adjacent light sources 30. The net result is increased uniformity of light that exits aperture 28. For example, signal assembly 40 can produce highly uniform light that exits aperture 28 with efficiencies that approach 20%.

It should be understood that the foregoing relationships of spacing 12, 32; depth 14, 34 and the predetermined factor A for signal assemblies 20 and 40 are exemplary. Larger D/d ratios (i.e., the depth 14, 34 is increasingly larger relative to the spacing 12, 32) need less scattering through diffuser 16, 36 and/or smaller LED beam angles 4, 24*a*, 24*b* to achieve the desired light uniformity. This translates to the use of a diffuser 6, 26 with a smaller divergence angle, e.g., ≥20° and/or an LED source 10, 30 with a smaller beam angle 4, 24*a*, 24*b*, e.g., ≥70°. On the other hand, when the D/d ratio is reduced, more light scattering is necessary through diffuser 6, 26 and/or higher beam angles 4, 24*a*, 24*b* are needed to achieve the desired light uniformity. As such, a diffuser 6, 26 with a larger divergence angle, e.g., ≥30°, and/or an LED-based light source 10, 30 with a larger beam angle 4, 24*a*, 24*b*, e.g., ≥100°, can be acceptable to incorporate within the signal assembly 20 and 40 configurations when D/d ratios are reduced (e.g., "low profile" signal assembly 20, 40 designs).

It should also be understood that the foregoing relationships can be "local" in the sense that the aperture 8, 28; depth 14, 34 and spacing 12, 32 need not be constant throughout the entire signal assemblies 20 and 40. For example, aperture 8, 28 may take on a variety of shapes, including circular, elliptical, rectangular and square shapes, each with varying degrees of curvature. As such, the aperture 8, 28 need not have a uniform shape. Similarly, the light sources 10, 30 arranged on the back side of chamber 16, 36 within cavity 16*a*, 36*a* need not be arranged in a line as depicted in exemplary fashion in FIGS. 1 and 2. Other patterns of arrangement for sources 10, 30 are possible in view of the interior shape and surface area of the back surface of cavity 16, 36 and the shape of aperture 8, 28. As such, the spacing 12, 32 can be defined in the sense that each source 10, 30 is spaced from immediately adjacent sources 10, 30 by spacing 12, 32, independent of whether the sources 10, 30 are arranged in a linear fashion, or another pattern. Still further, depth 14, 34 may vary, particularly in the sense that aperture 8, 28 and the back side of chamber 16, 36 can vary and possess non-uniform shapes and curvatures. Ultimately, the foregoing relationships between depth 14, 34 and spacing 12, 32 for signal assemblies 20 and 40 should be satisfied locally depending on the local depth 14, 34; and local spacing 12, 32 at a given location within cavity 16*a*, 36*a*.

Signal assembles 20 and 40 may be flexibly employed in a variety of lighting technologies and applications, including vehicular signal applications. As such, the chamber 16, 36 of signal assemblies 20, 40, including aperture 8, 28 and diffuser 6, 26, may be shaped and dimensioned for use in DRL, turn signal, brake signal, tail light signal, reverse signal, and other vehicular signal applications. It should be understood that lens aperture 8, 28 and/or diffuser 6, 26 may include various color filters associated with the appropriate vehicular signal application. For example, aperture 8, 28 may include a red filter for variants of signal assembly 20, 40 to be employed in brake and tail lamp signal applications. Further, sources 10, 30 employed in signal assembly 20, 40 may be powered and sized based on the type of application, applicable regulations and other engineering constraints.

Figure 3:
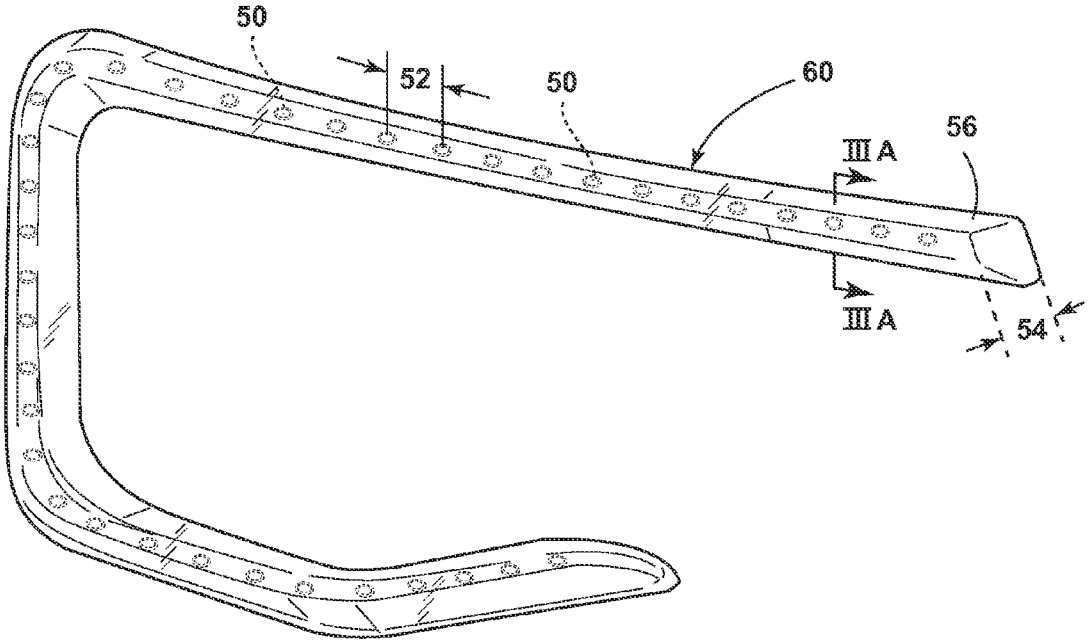
FIG. 3 is a cut-away perspective view of a signal assembly configured to operate as a vehicular tail-lamp according to a further embodiment.
Figure 3A:
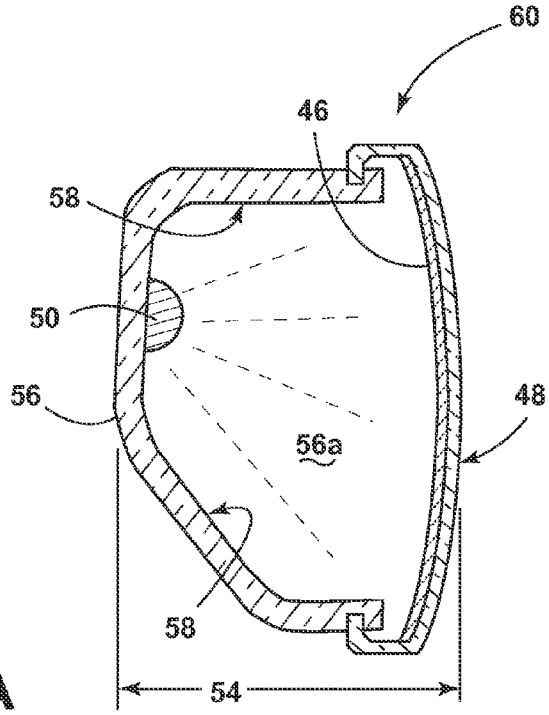
FIG. 3A is a cross-sectional view of the signal assembly depicted in FIG. 3.

As shown in FIGS. 3 and 3A, a tail-light assembly 60 is depicted according to a further embodiment. The tail-light assembly 60 produces highly uniform light emanating from LED sources 50 for use in vehicular tail-light signal functions. In all other respects, it is configured according to the same principles described in the foregoing associated with signal assemblies 20, 40. Further, tail-light assembly 60 includes components that function comparably to, and are the same as or identical to, those employed by signal assemblies 20, 40.

Tail-light assembly 60 is arranged in a tail-light configuration with a chamber 56, cavity 56*a* and lens aperture 48 all dimensioned to conform to the rear of a vehicle. The chamber 56 is defined by isotropically luminant back and side surfaces 58, and a front surface having a lens aperture 48 and a diffuser 46.

As shown in FIGS. 3 and 3A, each of the LED light sources 50 employed by tail-light assembly 60 is coupled to the back surface of the chamber 56, within cavity 56*a*. LED light sources 50 used in tail-light assembly 60 may produce light according to various beam angles (not shown) ≥70°, and more preferably, ≥100°. Further, the cavity 56*a*, each source 50, and the lens aperture 48 define a lens exit angle (not shown). Accordingly, the light that emanates from light sources 50 is directed toward the diffuser 46 and lens aperture 48 at a particular beam angle, but further confined by a lens exit angle. As such, some light emanating from sources 50 impinges on the isotropically luminant surfaces 58 rather than directly exiting through diffuser 46 and aperture 48. These light rays, by virtue of striking isotropically luminant surfaces 58, are reflected and spread within cavity 56*a*. Eventually, these reflected light rays also exit cavity 56*a* through diffuser 46 and lens aperture 48.

Light rays within cavity 56*a* that have emanated directly from sources 50, and those that have been reflected off of isotropically luminant surfaces 58, pass through diffuser 46. Diffuser 46 then causes the light rays originating from sources 50, typically LED-based sources, to further scatter, spread and blend. This has the effect of improving the uniformity of the light rays exiting diffuser 46 and, ultimately, aperture 48. Diffuser 46 can possess a divergence angle ≥15°, ≥20°, or even ≥30°.

The back and front surfaces of chamber 56 are separated by a depth 54, as further depicted in FIGS. 3 and 3A. Each light source 50 is located at a spacing 52, apart from adjacent sources 50. The relationship between the spacing 52 and depth 54 is an aspect of tail-light assembly 60 that allows it to produce highly uniform light emanating from aperture 48. In particular, the spacing 52 (d) of the sources 50 is set≤the depth 54 (D) of the assembly 60 divided by a predetermined factor, A. As such, the relationship of spacing 52, depth 54 and a predetermined factor A for lighting assembly 60 can be expressed as: D/d≥A. For a diffuser 46 with a divergence angle ≥20°, the predetermined factor A should be set to approximately 2.5.

As further shown by FIGS. 3 and 3A, the relationships between depth 54 (D), spacing 52 (d) and the predetermined factor, A are relatively constant over the dimensions of the assembly 60. Even though the chamber 56 and aperture 48 possess non-uniform shapes, the relative cross-section of the tail-light assembly 60 is fairly constant. As such, the foregoing relationships between D and d (depending on the type of source and diffuser selected) can be satisfied with relatively constant LED source spacing 52 and depth 54 across the entirety of the chamber 56 employed by tail-lighting assembly 60.

Certain recitations contained herein refer to a component being "configured" or "adapted to" function in a particular way. In this respect, such a component is "configured" or "adapted to" embody a particular property, or function in a particular manner, where such recitations are structural recitations as opposed to recitations of intended use. More specifically, the references herein to the manner in which a component is "configured" or "adapted to" denotes an existing physical condition of the component and, as such, is to be taken as a definite recitation of the structural characteristics of the component.

Variations and modifications can be made to the aforementioned structure without departing from the concepts of the present invention. Further, such concepts are intended to be covered by the following claims unless these claims by their language expressly state otherwise.

We claim:

1. A signal assembly, comprising:

a chamber defined by isotropically luminant back and side surfaces, and a front surface having a lens and a diffuser; and LED light sources having a beam angle ≥70° coupled to the back surface, wherein the back and front surfaces are separated by a depth, and each source is located at a spacing from the other sources ≤the depth divided by a predetermined factor between approximately 2.0 and 2.5.

2. The signal assembly according to claim 1, wherein the diffuser has a divergence ≥20° and the predetermined factor is approximately 2.5.

3. The signal assembly according to claim 1, wherein the diffuser has a divergence ≥30° and the predetermined factor is approximately 2.0.

4. The signal assembly according to claim 2, wherein the chamber and the LED light sources are configured to operate together as a vehicular signal lamp.

5. The signal assembly according to claim 3, wherein the chamber and the LED light sources are configured to operate together as a vehicular signal lamp.

6. The signal assembly according to claim 4, wherein the vehicular signal lamp is selected from the group consisting of a daytime running lamp, turn signal lamp, tail lamp, reverse lamp, and brake signal lamp.

7. The signal assembly according to claim 5, wherein the vehicular signal lamp is selected from the group consisting of a daytime running lamp, turn signal lamp, tail lamp, reverse lamp, and brake signal lamp.

8. The signal assembly according to claim 2, wherein the lens has a shape from the group consisting of circular, elliptical, rectangular and square shapes.

9. The signal assembly according to claim 3, wherein the lens has a shape from the group consisting of circular, elliptical, rectangular and square shapes.

10. The signal assembly according to claim 2, further comprising light produced by the LED light sources that exits the lens at 20% or greater efficiency.

11. The signal assembly according to claim 3, further comprising light produced by the LED light sources that exits the lens at 20% or greater efficiency.

12. A signal assembly, comprising:

a chamber defined by isotropically luminant back and side surfaces, and a front surface having a lens and a diffuser; and LED light sources having a beam angle ≥100° coupled to the back surface, wherein the back and front surfaces are separated by a depth, and each source is located at a spacing from the other sources ≤the depth divided by a predetermined factor between approximately 2.0 and 2.5.

13. The signal assembly according to claim 12, wherein the diffuser has a divergence ≥15° and the predetermined factor is approximately 2.5.

14. The signal assembly according to claim 13, wherein the chamber and the LED light sources are configured to operate together as a vehicular signal lamp.

15. The signal assembly according to claim 14, wherein the vehicular signal lamp is selected from the group consisting of a daytime running lamp, a brake lamp, tail lamp, reverse lamp, and a turn signal lamp.

16. The signal assembly according to claim 13, wherein the lens has a shape from the group consisting of circular, elliptical, rectangular and square shapes.

17. The signal assembly according to claim 13, further comprising light produced by the LED light sources that exits the lens at 20% or greater efficiency.

18. A signal assembly, comprising:

a chamber defined by isotropically luminant back and side surfaces, a depth, and a front surface having a lens aperture and a diffuser; and bi-directional LED light sources coupled to the back surface, each having beam angles ≥light exit angles defined by the sources and the aperture, wherein each source is located at a spacing from the other sources ≤the depth divided by a predetermined factor between approximately 2.0 and 2.5.

19. The signal assembly according to claim 18, wherein the diffuser has a divergence ≥20° and the predetermined factor is approximately 1.0.

20. The signal assembly according to claim 19, further comprising light produced by the LED light sources that exits the lens aperture at 20% or greater efficiency.

* * * * *